United States Patent [19]

Haswell et al.

[11] 3,953,995

[45] May 4, 1976

[54] MEANS FOR MAKING DOUBLE GROOVE PULLEYS

[76] Inventors: John W. Haswell; Stanley A. Haswell, both of c/o Master Craft Engineering, Inc., 39555 Express Highway, Belleville, Mich. 48111

[22] Filed: May 27, 1975

[21] Appl. No.: 581,046

[52] U.S. Cl. ..... 72/84; 72/105; 29/159 R

[51] Int. Cl.[2] ..... B21H 1/00

[58] Field of Search ..... 72/84, 105, 106; 29/159 R, 159.01; 1/113

[56] References Cited

UNITED STATES PATENTS

| | | | |
|---|---|---|---|
| 3,754,424 | 8/1973 | Costanzo | 72/105 |
| 3,831,414 | 8/1974 | Haswell et al. | 29/159 |
| 3,852,863 | 12/1974 | Killian et al. | 29/159 |

FOREIGN PATENTS OR APPLICATIONS

| | | | |
|---|---|---|---|
| 844,587 | 7/1952 | Germany | 72/105 |

*Primary Examiner*—Lowell A. Larson
*Attorney, Agent, or Firm*—McNenny, Farrington, Pearne & Gordon

[57] ABSTRACT

An apparatus is provided for forming a pulley having at least two grooves from a cup-shaped blank having an axially extending sidewall. The blank is crushed between axially closing dies and as the blank is being crushed, at least two rolls are translated radially into contact with the outer surface of the blank sidewall while the blank is rotated to form at least two annular pulley grooves in the sidewall of the blank. During such translation, a forming roll positioned between the axially closing dies and within the cup is radially shifted away from the longitudinal axis of the cup and into contact with the inner sidewall thereof to form a land between pulley groove pairs.

8 Claims, 4 Drawing Figures

MEANS FOR MAKING DOUBLE GROOVE PULLEYS

BACKGROUND OF THE INVENTION

This invention relates generally to the art of forming one-piece, multiple groove pulleys from cup-shaped pulley blanks. There are significant problems in manufacturing concentric one-piece, single groove pulleys and those problems are compounded in the manufacture of multiple groove pulleys. For example, in a double groove pulley the grooves are separated by a land or circumferential rib located between the pulley grooves and which is an outwardly directed bulge between those grooves. During the formation of the pulley, that land must be supported by internal tooling within the cup, which serves as a backup as the pulley grooves are being formed. That tooling must be retracted from the land after the formation of the pulley grooves in order to permit removal of the completed pulley from the pulley-making machine. It has been proposed that such tooling be a removable rubber ring in the case of double groove pulley formed by segmented outer pulley groove-forming dies (U.S. Pat. No. 3,124,090) or such tooling may be segmented and expandable inner die employed in a spinning operation (U.S. Pat. No. 2,892,431).

It has been found that when using an internal segmented die to back the land, the segmented die tends to stick in the groove after the crushing operation, necessitating the hammering of the blank to free it from the die. A further disadvantage of segmented internal dies is the fact that many of those dies leave tooling marks on the pulley and provide a land which is not truly concentric.

Another type of internal tooling for forming the land between adjacent pulley grooves is a rubber block that will tend to expand into the land upon the application of axial pressure to the cup and which will return to a contracted position when the pressure is no longer applied. Although such rubber blocks do not tend to score the cup, they require frequent replacement and tend to change their dimensions upon repeated machine cyclings. An example of such tooling may be found in U.S. Pat. No. 3,124,090 and U.S. Pat. No. 2,929,345.

SUMMARY OF THE INVENTION

This invention overcomes many of the foregoing prior art problems associated with the formation of a multigroove, one-piece pulley. According to this invention, there are provided techniques for forming a bulge in the sidewall of a cup-shaped blank and crushing the blank between axially closing dies. As the blank is being crushed, at least two rolls are translated radially into contact with the outer surface of the blank sidewall while the blank is being rotated to form at least two angular pulley grooves in the sidewall of the blank. During the translation, a forming roll is positioned within the blank and is radially shifted away from the longitudinal axis of the cup and into contact with the inner sidewall to form a land between pulley groove pairs.

More specifically, a cup-shaped blank is bulged or preformed at a first station. The first station includes upper and lower dies which are rotatably driven about a longitudinal axis and which are capable of being translated toward each other to axially crush a cup-shaped blank positioned therebetween. Mounted within and projecting through the lower die is an inner forming die having upper and lower bulges in its sidewall. The inner die is capable of transaxial movement away from the longitudinal axis of and toward the inner sidewall of the cup-shaped blank. A cooperating outer roll capable of transaxial movement toward the longitudinal axis and the outer sidewall of the cup is also provided. The inner and outer roll or die members are moved toward each other by cams as the upper and lower die members are moved toward each other so that upper and lower bulges are formed in the sidewall of the cup. It has been found that an outer roll is not needed to form the upper bulge, since this bulge tends to form itself, due to the crushing action, without external forming means on the sidewall.

After the cup is preformed in this manner, the bulged blank is moved to the second station, where a completed double groove, one-piece pulley is formed. The second die station includes upper and lower dies which are movable toward each other to crush the blank therebetween. The upper and lower dies are driven for rotation about a longitudinal axis. An inner roll die is provided which projects through the lower die and into the cup adjacent the lower bulge thereof. The inner roll die is capable of transaxial movement toward the inner sidewall and away from the longitudinal axis of the cup. An outer roller die member is provided which is rotatably mounted and which is capable of transaxial movement toward the outer sidewall of the cup and which has two roller portions capable of floating movement relative to each other. As the upper and lower dies are translated toward each other, the inner die is cammed toward the inner sidewall of the cup and the outer roller die member is cammed toward the outer sidewall of the cup. Thus, while the cup is being rotated and crushed, the inner die member forms a land between adjacent pulley grooves, while the outer die member forms those grooves. The top bulge is completely crushed on the outer die member to form one wall of the upper pulley groove. When the upper and lower dies are translated away from each other, the inner die member returns to a centered position, permitting easy removal of the finished pulley, while the outer die member moves to a clear position spaced from the pulley.

DETAILED DESCRIPTION OF THE INVENTION

Figure 1:
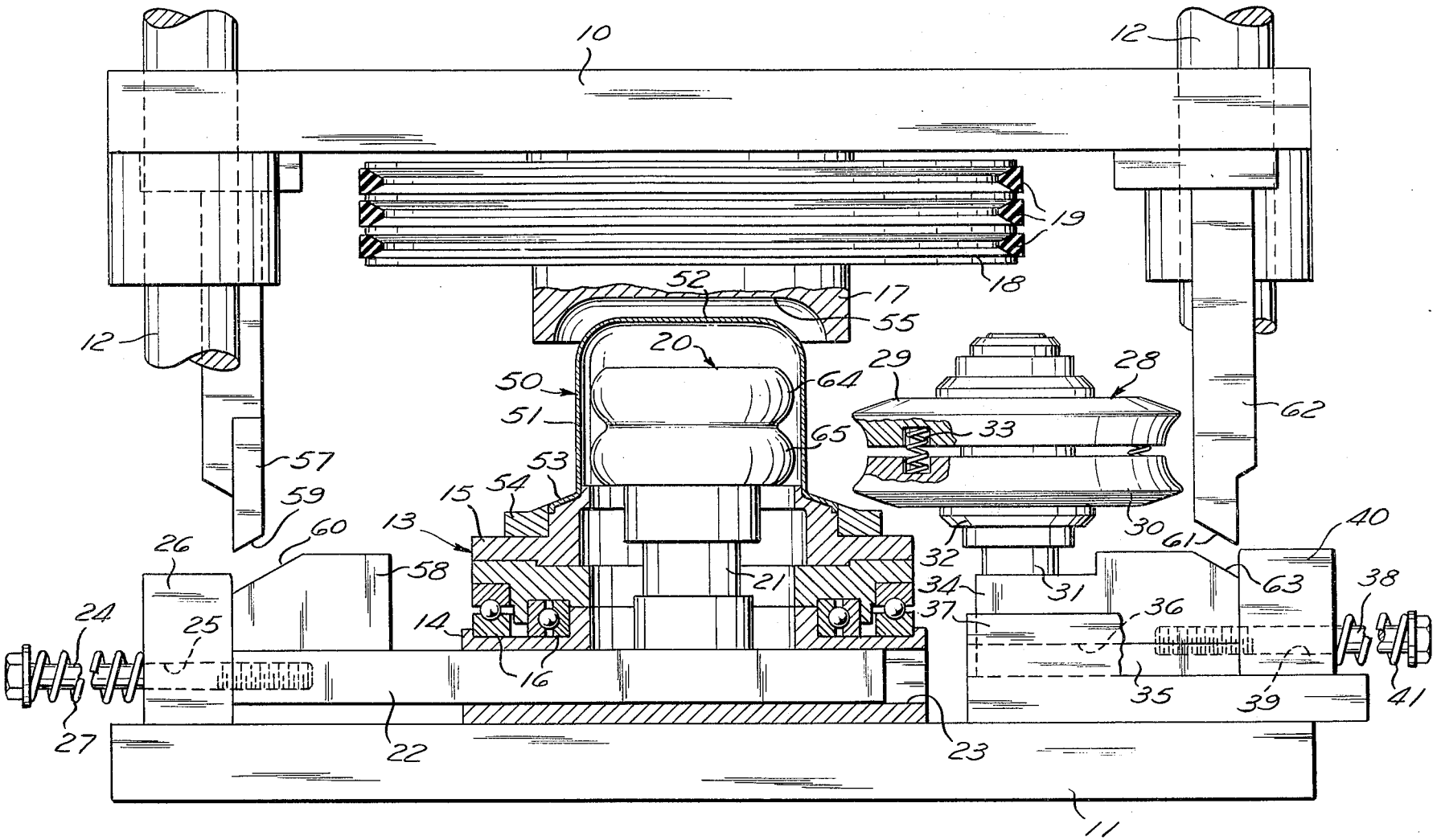
FIG. 1 is an elevational view, partly in section, of the first station of a pulley making machine.
Figure 2:
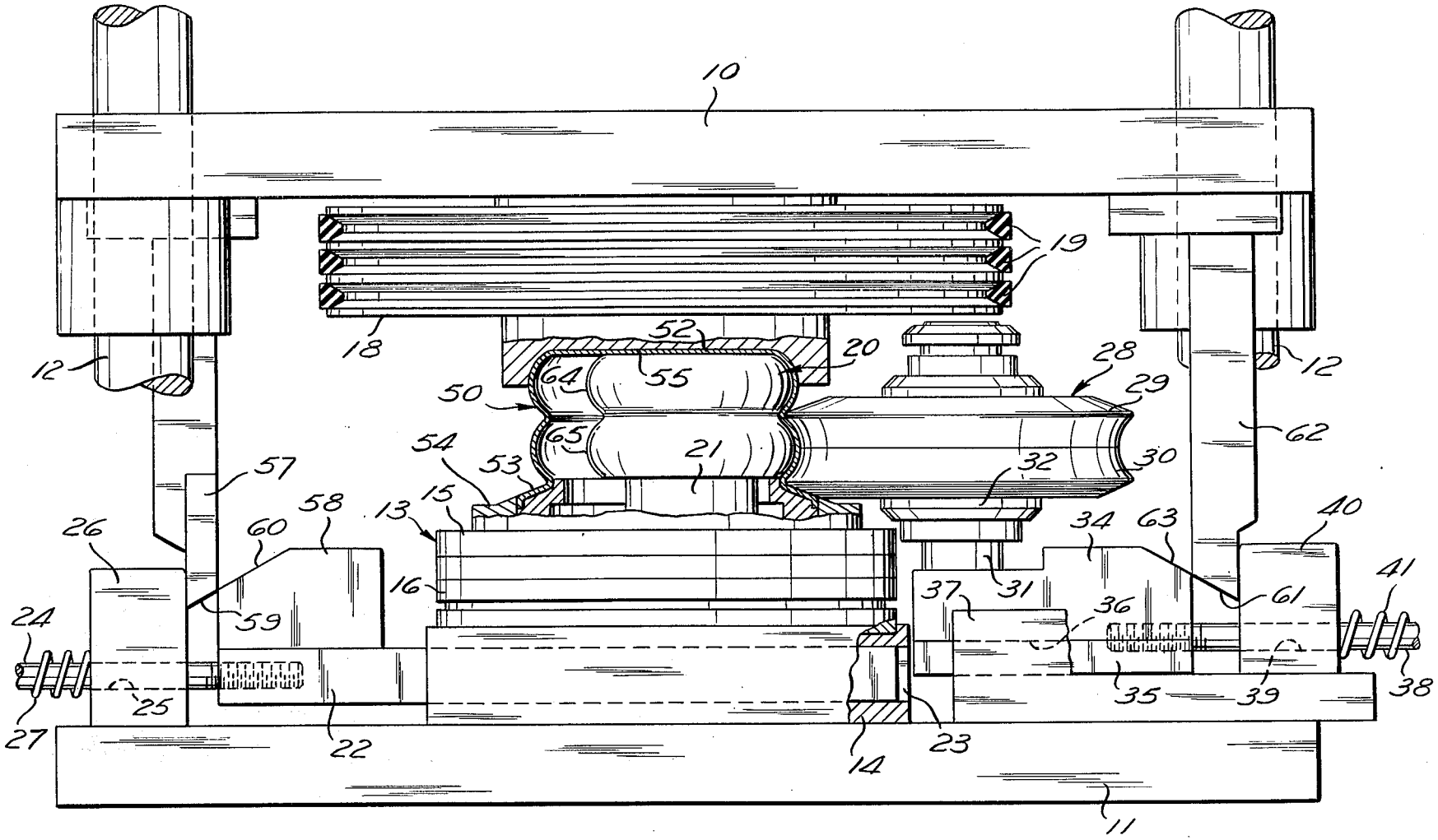
FIG. 2 is an elevational view, partly is section, similar to FIG. 1 but showing the forming rollers and dies in a final forming position to produce a bulged blank.

Referring now to the drawings, and particularly to FIGS. 1 and 2, there is illustrated the first station of a machine for making double groove pulleys. The first station includes upper and lower platens 10 and 11, respectively. The upper platen 10 is movable relative to the lower platen 11, and it is guided by four guide rods 12 (only two of which are illustrated) fixed to the lower platen 11 and slidably received at each corner of the upper platen 10. The upper platen 10 may be moved toward the lower platen 11 by the ram (not shown) of a hydraulic press.

Mounted on the lower platen 11 is a lower die assembly 13 which includes a base member 14 fixed to the platen 11 and a rotatable die member 15 mounted on the member 14 by bearings 16. The member 14 and the rotatable member 15 have a hollow central core.

There is provided an upper crushing die 17 mounted for rotation on the upper platen 10 and which has a multigroove pulley 18 keyed thereto. Belts 19 and a motor (not shown) are adapted to drive the upper forming die 17 about its longitudinal axis.

Slidably associated with the lower platen 11 is an inner forming roll die 20 which is rotatably mounted on a pedestal 21. The pedestal 21 is fixed to a cross slide 22 which is slidably received within a cross slot 23 in the base 14. The cross slide 22 is provided with a bolt 24 threaded into one end and being slidably received through a bore 25 in a stationary block 26. The bolt 24, and therefore the cross slide 22, are biased toward the left by a compression spring 27 to maintain the cross slide 22 in engagement with the block 26 and to maintain the roll die 20 in a normally centered position with respect to the upper and lower dies 17 and 13.

There is provided an external forming roll die assembly 28 which is translatable toward the longitudinal axis of the upper and lower dies 17 and 13. The roll die assembly 28 includes a pair of initially spaced rollers 29 and 30, which are mounted on a pedestal 31 by a bearing 32. The rollers 29 and 30 are keyed together to prevent rotation relative to each other, and are initially biased apart by springs 33. The pedestal 31 is fixed to a cam die block 34 which has a key-shaped flange 35 at its lower face. The flange 35 is slidably received within a T-shaped slot 36 in a fixed block 37. A bolt 38 is threaded into one end of block 34 and slidably extends through an aperture 39 in a fixed block 40. The block 34 is normally biased against the block 40 by a compression spring 41 mounted on the bolt 38.

To perform a bulging operation, a cup-shaped blank 50 is placed on the lower die 13. The blank 50 has a cylindrical sidewall 51, a closed end 52, and a flared open end 53. The flared open end 53 is restrained against radial displacement by a retaining ring 54 mounted on the lower die 13. The ram of the press is actuated to move the upper die 17 toward the lower die 13 and engage the closed end 52 of the cup-shaped blank 50 in a recess 55 in the upper die 17. Since the upper die 17 is being spun about its longitudinal axis, the blank 50 will be spun together with the die portion 15 when the die 17 engages the blank. Movement of the upper die toward the lower die also causes a cam block 57 fixed to the upper platen 10 to strike a cam block 58 fixed to the cross slide 22. A sloped surface 59 on the cam 57 engages an identically sloped surface 60 on the cam 58 to shift the cam 58, and therefore the cross slide 22, to the right as viewed in FIGS. 1 and 2, to shift the roller die 20 away from the longitudinal axis of the upper and lower dies 17 and 15 and toward the cylindrical sidewall 51 of the blank 50.

In like manner, upon downward movement of the platen 10, a sloped surface 61 of a cam 62 fixed to the upper platen 10 engages an identically sloped surface 63 of the block 34 to cause the block 34 to shift to the left against the bias of the spring 41 to move the roller die assembly 28 toward the longitudinal axis of the upper and lower dies 17 and 13 and into engagement with the cylindrical sidewall of the cup 50. Thus, as the upper die 17 engages and begins to crush the cup 50, the roller dies 20 and 28 move into engagement with the cylindrical sidewall 51 of the cup 50. It may be noted that the roller die 20 is provided with first and second bulges 64 and 65 in its sidewall, and that the bulge 65 is adapted to conform with the peripheral curvature of the roller die portions 29 and 30.

Referring particularly to FIG. 2, it may be noted that the roller die portion 29 is moved into engagement with the die portion 30 as the portion 29 rides down the portion of the sidewall 51 which is being conformed to the lower curved segment of the bulge 64. At the completion of the bulging operation, the upper portion of the blank 50 is conformed to the recess 55 by the upper segment of the bulge 64 and the die segments 29 and 30 conform the sidewall of the blank to the bulge 65. After the assembly achieves the condition illustrated in FIG. 2, the platen 10 is raised and the roller dies 20 and 28 are returned to their initial position by the springs 27 and 41. The bulged blank is then removed from the lower die 13 and transferred to the second station, as is illustrated in FIG. 3.

Figure 3:
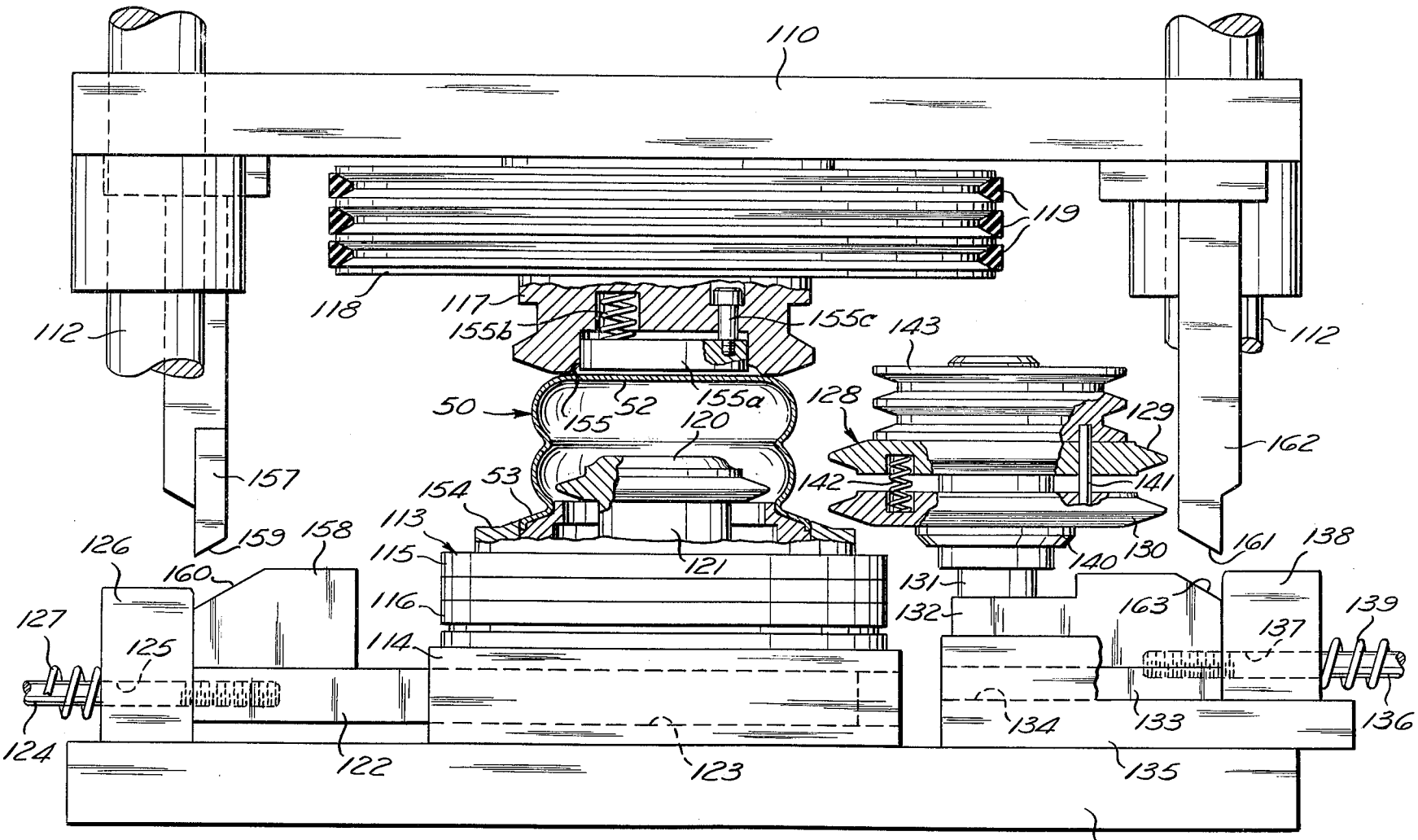
FIG. 3 is an elevational view, partly in section, of the second station of the machine showing a bulged blank about to be formed into a pulley.

Referring now to FIG. 3, there is illustrated station two of the double groove pulley making machine. That machine includes an upper platen 110 and a lower platen 111. The lower platen 111 is mounted on the bed of a suitable hydraulic press and the upper platen 110 is driven toward and away from the lower platen by the press ram (not shown). The upper platen 110 is guided toward and away from the lower platen 111 by four guide posts 112 which are fixed to the lower platen 111 and which slidably extend through the upper platen 110 adjacent its corners.

Associated with the lower platen 111 is a lower die assembly 113 which includes a base 114 fixed to the platen 111 and a lower forming die member 115 rotatably mounted on the base 114 by bearings 116.

Rotatably fixed to the upper platen 110 is an upper forming die 117 which is mounted in suitable bearings and which carries a multiple-groove driving pulley 118. The pulley 118 is driven by suitable belts 119 associated with a drive motor (not shown).

It may be noted that the lower die assembly 113 is hollow and an inner roll forming die 120 projects therethrough. The forming die 120 is mounted on a pedestabl 121 by suitable bearings which permit axial rotation of the die 120. The pedestal 121 is fixed to a cross slide 122 which is slidingly received in a slot 123 provided in the base 114. The slide 122 has a bolt 124 threaded in one end and the bolt 124 slidably extends through a bore 125 in a block 126. A compression spring 127 urges the slide 122 to the left, as viewed in FIG. 3, and against the block 126 to maintain the inner roll die 120 in a normally centered position with respect to the upper and lower dies 117 and 113.

There is also provided an external forming roll die assembly 128 which is translatable toward the longitudinal axis of the upper and lower dies 117 and 113. The roll die assembly 128 includes an initially spaced upper die roll 129 and a lower die roll 130. The assembly 128 is rotatably mounted on a pedestal 131 by a bearing 140. The rolls 129 and 130 are keyed together to prevent rotation relative to each other by a pin 141 which is fixed in the roll 129 and which is slidably received in the roll 130. The rolls 129 and 130 are initially biased apart by at least one spring 142. If it is desired to drive the roll die assembly 128 rather than the die 117, a multigroove pulley 143 may be provided on the assembly 128. The pedestal 131 is fixed to a cam block 132. The cam block 132 has a T-shaped flange 133 which is slidably received in a T-slot 134 provided in a block 135 fixed to the lower platen 111. A bolt 136 is threaded into the block 132 and is slidably received through a bore 137 in a fixed block 138. The block 132 is normally biased against the block 138 by a compression spring 139 mounted on the bolt 136.

To form a multigroove pulley from the bulged blank, the bulged blank 50 is placed on the lower die 113. The flared open end 53 is restrained against radial displacement by a retaining ring 154 mounted on the lower die 113. The ram of the press is actuated to move the upper die 117 toward the lower die 113 and engage the closed end 52 of the bulged blank in a recess 155 in the upper die 117. Provided in the recess 155 is a plate 155*a* which is spring-biased out of the recess by at least one spring 155*b* and is retained therein by at least one guide pin 155*c*. Since the upper die 117 is being spun around its longitudinal axis, the blank 50 will be spun together with the die portions 115 when the die 117 engages the blank. Movement of the upper die toward the lower die also causes a cam block 157 fixed to the upper platen 110 to strike a cam block 158 fixed to the cross slide 122. A sloped surface 159 on the cam 157 engages an identically sloped surface 160 on the cam 158 to shift the cam 158, and therefore the cross slide 122, to the right, as viewed in FIGS. 3 and 4, to shift the roller die 120 away from the longitudinal axis of the upper and lower dies 117 and 115, and toward the bulged sidewall of the blank.

In like manner, upon downward movement of the platen 110, a sloped surface 161 of a cam 162 fixed to the upper platen 110 engages an identically sloped surface 163 of the block 132 to cause the block 132 to shift to the left against the bias of the spring 139 to move the roller assembly 128 toward the longitudinal axis of the upper and lower dies 117 and 113 and into engagement with the bulged sidewall of the cup 50.

Figure 4:
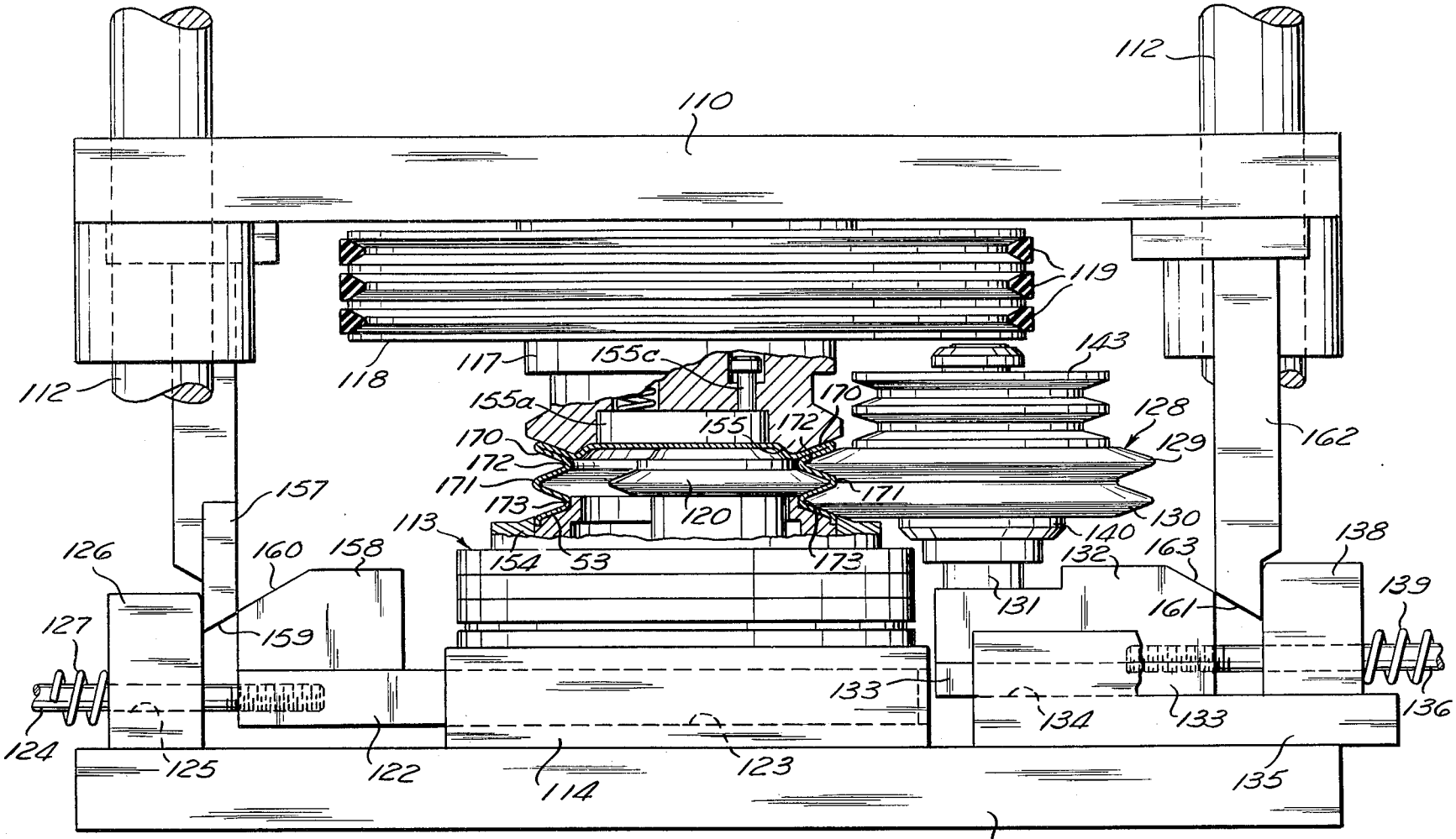
FIG. 4 is an elevational view, partly in section, of the machine illustrated in FIG. 3 but showing the forming rolls and dies in a closed position to produce a double groove pulley.

Referring more particularly to FIG. 4, it may be noted that the roll 129 is moved into engagement with the roll 130 as the top die 117 crushes the upper top bulge between itself and the roll 129 to form a pulley flange 170. At the same time, the forming die 120 forces metal from the lower bulge into the groove defined by the rollers 129 and 130 to form a land 171 between adjacent pulley grooves 172 and 173. After the assembly achieves the condition illustrated in FIG. 4, the platen 110 is raised and the roller dies 120 and 128 are returned to their initial position by the springs 127 and 139. The completed pulley is then removed from the lower die 113 and it may be noted that the spring-biased plate 155*a* prevents the pulley from being held captive in the recess 155.

It should also be noted that it is not essential to form a lower bulge in the pulley blank, since this portion of the blank sidewall is forced outwardly by the forming die 120. Therefore, the die assembly 28 and the bulged portion 65 of the die 20 may have cooperating cylindrical peripheries which hold the lower portion of the blank to a cylindrical configuration, while the upper portion of the blank is bulged, as was previously described.

The invention is not restricted to the slavish imitation of each and every detail set forth above. Obviously techniques and devices may be devised which change, eliminate or add certain specific details without departing from the scope of the invention.

What is claimed is:

1. A machine for forming a pulley having a plurality of pulley grooves of given cross section from a pulley blank in the form of a cup, each groove being defined by pulley wall means connected through the root of the groove and each groove being separated from an adjacent groove by a land, comprising axially movable members for engaging said blank adjacent opposed axial ends thereof, means to axially advance at least one of said axially movable members toward the other to a final apposition at which they define a die cavity, first and second rotatably mounted roll die means, said first roll die means being translatable toward the longitudinal axis and the outer sidewall of the cup and having a periphery adapted to roll form the periphery of the blank to a desired configuration, said second roll die means being positioned between said axially movable members, being translatable away from the longitudinal axis and toward the inner sidewall of the cup, and having a periphery adapted to complement the periphery of the first roll die means and to roll form the periphery of the blank to said desired configuration, means to establish relative rotation between said pulley blank and said forming rolls, first roll die moving means to advance said first roll die means from a retracted position toward said longitudinal axis and to a final forming position at which it defines a die cavity corresponding to further portions of a desired configuration, second roll die moving means to advance said second roll die means away from said longitudinal axis toward said first roll die means to said final forming position at which it and said first roll die means together define said further portions of said desired configuration, said first and second roll die moving means being arranged to substantially simultaneously stop the advance of said first and second roll die means at said final forming position.

2. A machine for forming a pulley according to claim 1, wherein said first roll die means has a pair of spaced projecting V-shaped peripheries and wherein said second roll die means has a projecting V-shaped periphery adapted to enter the space between the spaced pair of peripheries.

3. A machine for forming a pulley according to claim 1, wherein said first and second roll die moving means are moved in response to movement of said axially movable members toward and away from each other.

4. A machine for forming a pulley according to claim 1, wherein said axially movable members are fixed to and movable with upper and lower platens and wherein said first and second roll die moving means comprise first and second cross slide members respectively fixed to said first and second roll die means and slidable along said lower platen, a cam member fixed to each slide member, and cooperating cam members fixed to the upper platen and adapted to engage the cam members fixed to the slide members to translate said first and second roll die means.

5. A machine for forming a pulley according to claim 1 wherein said means to axially advance at least one of said axially movable members toward the other to said final apposition are arranged to dispose said axially movable members in said final apposition substantially simultaneously with the disposition of said first and second roll die means at said final forming position.

6. A machine for forming a pulley having a plurality of pulley grooves of given cross section from a pulley blank in the form of a cup, each groove being defined by pulley wall means connected through the root of the groove and each groove being separated from an adjacent groove by a land, said cup having at least one bulge with said at least one bulge being located adjacent the closed end of the cup, comprising axially movable members for engaging said blank adjacent opposed axial ends thereof, means to axially advance at least one of said axially movable members toward the other to a final apposition at which they define a die cavity corresponding to portions of said pulley first and second roll die means, said first roll die means comprising a forming roll for each groove, said second roll die means comprising a forming roll for each land, means to establish relative rotation between said pulley blank and said forming rolls about a longitudinal axis, first roll die moving means to advance said first roll die means from a retracted position toward said longitudinal axis to a final forming position at which it defines a die cavity corresponding to further portions of said pulley, second roll die moving means to advance said second roll die means away from said longitudinal axis toward said first roll die means to said final forming position at which it forms said land and at which it forms remaining portions of said pulley, said first and second roll die moving means being arranged to substantially simultaneously stop the advance of said first and second roll die means at said final forming position.

7. A machine for forming a pulley according to claim 6, wherein said first and second roll die moving means are moved in response to movement of said axially movable members toward and away from each other.

8. A machine for forming a pulley according to claim 6, wherein said axially movable members are fixed to and movable with upper and lower platens, and wherein said first and second roll die moving means comprise first and second cross slide members respectively fixed to said first and second roll die means, and slidable along said lower platen, a cam member fixed to each slide member, and cooperating cam members fixed to the upper platen and adapted to engage the cam members fixed to the slide members to translate said first and second roll die means.

* * * * *